US006724156B2

(12) United States Patent
Fregoso

(10) Patent No.: US 6,724,156 B2
(45) Date of Patent: Apr. 20, 2004

(54) CIRCUIT FOR DRIVING LIGHT-EMITTING DIODES

(75) Inventor: Gilbert Fregoso, Conner, MT (US)

(73) Assignee: Design Rite, LLC, Walnut, CA (US)

( * ) Notice: Subject to any disclaimer, the term of this patent is extended or adjusted under 35 U.S.C. 154(b) by 0 days.

(21) Appl. No.: 09/765,897

(22) Filed: Jan. 16, 2001

(65) Prior Publication Data

US 2002/0014862 A1 Feb. 7, 2002

Related U.S. Application Data

(60) Provisional application No. 60/176,110, filed on Jan. 14, 2000.

(51) Int. Cl.[7] ..... G05F 1/00

(52) U.S. Cl. ..... 315/291; 315/247; 362/183

(58) Field of Search ..... 315/291, 308, 315/309, 307, 224, 209 R, 200 A, 185 R, 77, 78, 80, 82, 247; 362/800, 240, 183, 202, 206, 71

(56) References Cited

U.S. PATENT DOCUMENTS 5,765,940 A 6/1998 Levy et al. ..... 362/240
5,914,865 A * 6/1999 Barbehenn et al. ..... 363/71
6,078,148 A * 6/2000 Hochstein ..... 315/291
6,150,771 A * 11/2000 Perry ..... 315/291
6,191,568 B1 * 2/2001 Poletti ..... 315/360
6,285,139 B1 * 9/2001 Ghanem ..... 315/291
6,296,367 B1 * 10/2001 Parsons et al. ..... 362/183
6,351,402 B1 * 2/2002 Carroll ..... 363/125

FOREIGN PATENT DOCUMENTS

EP 0567280 4/1993

OTHER PUBLICATIONS

Amos and Dummer, Newnes Dictionary of Electronics, first published in 1981, 4th Edition, pp. 168–169.*

Sherman, Len (Oct. 23, 1997) Logic Power Drives High–Intensity LEDs *Ideas for Design* vol. 2328: 142 and 144.

Hoffart, Fran (Dec. 15, 1997) Series LED Driver Operates on 3–V Input *Ideas for Design* vol. 2328: 106 and 108.

* cited by examiner

*Primary Examiner*—Wilson Lee
(74) *Attorney, Agent, or Firm*—Saliwanchik, Lloyd & Saliwanchik

(57) ABSTRACT

A circuit efficiently drives light emitting diodes (LEDs). The circuit uses a switching regulator device instead of a standard resistor to limit current to the LEDs. The switching regulator device is in a closed loop with a current sensing device near the LED lamps. Feedback from this current sensing device switches the control method according to the current load regulating the voltage applied to the LEDs. An inductive storage device in the circuit allows the LEDs to be driven with minimal voltage input. Methods for intensifying and focusing the light produced by the LEDs driven by the circuit are also described.

4 Claims, 4 Drawing Sheets

CIRCUIT FOR DRIVING LIGHT-EMITTING DIODES

This application claims priority to U.S. Provisional Patent Application Serial No. 60/176,110, filed Jan. 14, 2000. The specification of that application is hereby incorporated by reference in its entirety.

BACKGROUND OF THE INVENTION

Currently, dentists and surgeons use cumbersome headlamps to illuminate areas during intricate procedures such as surgery and dentistry. These headlamps typically incorporate halogen or other incandescent lamps which emit an uneven light in which the element is visible when the lamp is on. Further, such incandescent lamps can have high current demands. These headlamps are either battery-powered or plugged into a wall socket. Battery powered headlamps containing halogen or krypton bulbs burn hot and drain batteries quickly. Those headlamps which are plugged into a wall socket reduce the mobility of the surgeon and the chord presents a possible nuisance interfering with surgical procedures.

Light emitting diodes (LEDs) provide a clean, bright light with sharp edges. The clean, sharp light of an LED, when focused, can produce illumination of a brightness and intensity suitable for procedures such as surgery and dentistry. In addition, LEDs require less power than incandescent lamps. Illumination devices, such as flashlights, which are currently available and have LEDs require at least three batteries or 4.5 V of power. Excessive current or voltage applied to an LED can damage the diode. Therefore, to insure the voltage applied to the LEDs is not too great a simple resistor is typically placed in the circuit of these devices. The resistor limits the power applied to the LEDs and releases excess energy as heat. Thus, conventional LED flashlights waste energy, run hot, and are heavy with extras batteries and components. Current headlamps with LEDs are cumbersome and awkward. Further, available LED lamps have poor light output which begins to weaken almost immediately.

The clean, bright light of an LED is ideal for illuminating intricate surgical or dental procedures. From the foregoing, however, it is apparent that there is a need for a battery-powered, cool-burning headlamp with LEDs to provide light for these procedures. It would be most advantageous if the LEDs of these headlamps were driven by an efficient circuit which reduced the weight of the headlamp and provided maximum burn time.

SUMMARY OF THE INVENTION

The subject invention involves a circuit for driving light emitting diodes (LEDs). The subject circuit can enable the production of light from a device which is efficient and cool-burning. The subject invention also relates to apparatuses incorporating LEDs for the production of light. In a specific embodiment, the circuit comprises an inductive storage device, a switching regulator device, a rectifier and filter and, a current sensing device in a closed loop feedback system. The use of an inductive storage device can allow the circuit to function using a low voltage input. The switching regulator device can monitor and regulate the power applied to the LEDs, protecting the diodes. The circuit can illuminate a number of LEDs with a low voltage input. In a preferred embodiment, the subject system can be approximately 97% efficient.

The subject invention further relates to materials and methods for directing the light from one or more LEDs into a uniform diffuse light, or into a bright focused beam. Optical lenses can be used to superimpose individual diode beam patterns in order to provide a bright, clear beam. A second zoom lens can be used to further focus this beam of light, either scattering the beam to provide a uniform diffuse light or narrowing the beam to provide a bright, sharp light.

DETAILED DESCRIPTION OF THE INVENTION

The subject invention involves an efficient circuit for driving one or more light emitting diodes (LEDs). The subject invention can utilize an inductive storage device which can allow the circuit to function with low voltage input. Further, a switching circuit can be used in a closed loop feedback system to monitor and regulate the power supplied to the LEDs, thus protecting the diodes and allowing them to burn for extended periods.

Figure 1:
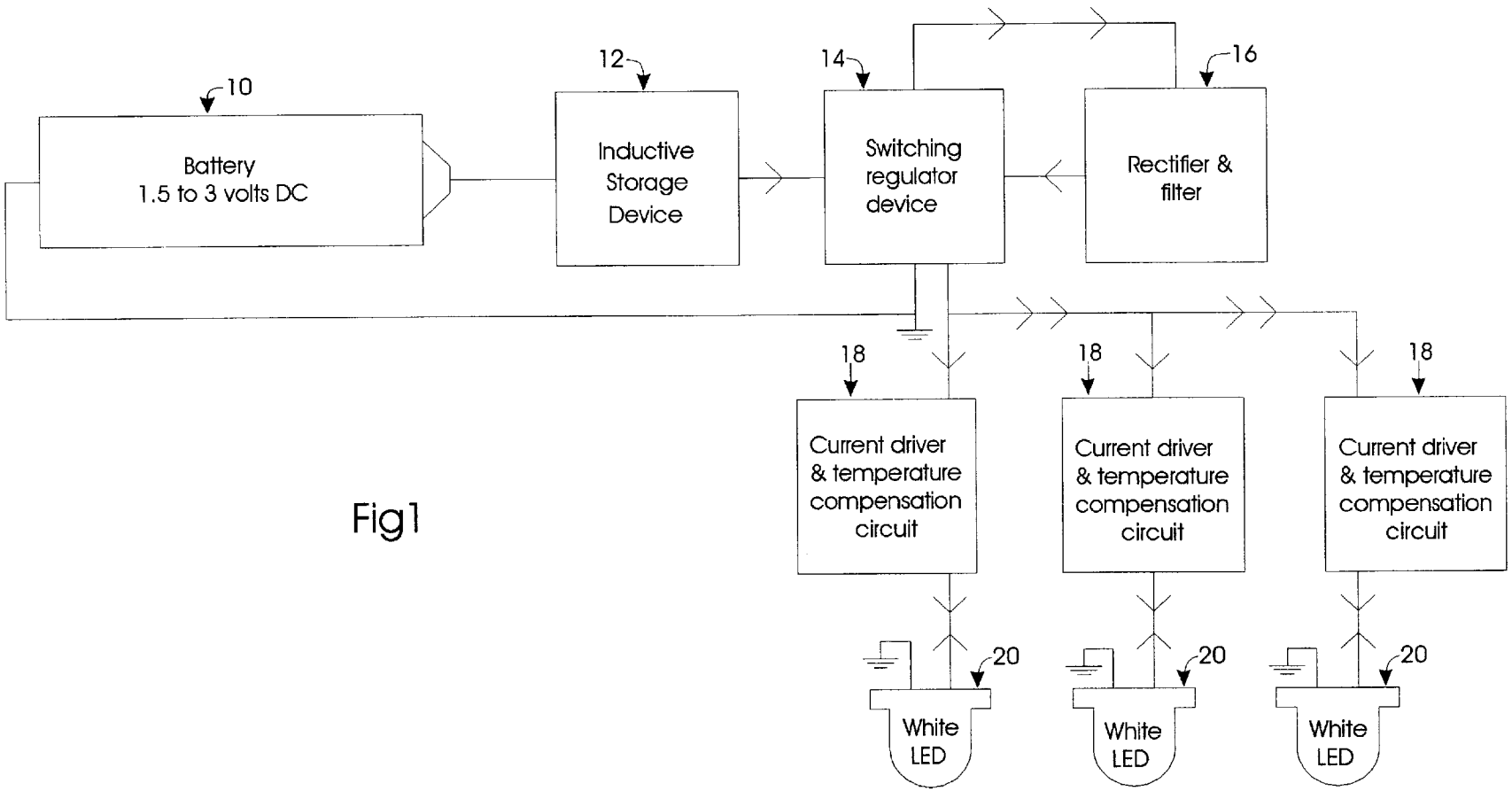
FIG. 1 shows a specific embodiment of a circuit in accordance with the subject invention.

A specific embodiment of the circuit of the subject invention is shown in FIG. 1. Batteries 10 provide DC current which is sent to an inductive storage device 12, such as an inductor. Preferably, the inductive storage device is wire wound with an inductance between about 22 and 220 micro henries. Wire wound inductors reduce resistance.

Current from the inductive storage device 12 goes to a high speed switching converter and regulator device. In a specific embodiment, the switching regulator device 14 can be an integrated circuit (IC) having a reference voltage source, an oscillation circuit, a power MOSFET, and an error amplifier. In a preferred embodiment the switching regulator device is a CMOS PWM/PFM-control step-up switching regulator.

Energy in the inductive storage device 12 is converted to AC current. Energy leaving the switching regulator device 14 is likewise AC current. Accordingly, this AC current can be rectified and filtered to DC current through a rectifier and filter 16. In a specific embodiment, a Schottky diode can be used as the rectifier and filter 16. A Schottky diode can provide a fast reverse recovery time and a low forward voltage drop. The rectified and filtered current is fed back to the switching regulator device 14 where it can be controlled and monitored for the proper voltage output.

The rectified and filtered DC output is sent to a current sensing device, which controls the current sent to the LEDs. In a specific embodiment, the current sensing device is a current driver and temperature compensation circuit 18 having an error amplifier, a current sensing resistor, and at least two reference voltage resistors. In a particularly preferred embodiment, the current sensing device further comprises a transistor used as a power driver. The current sensing and temperature compensation circuit controls the temperature, protecting the light emitting diodes (LEDs) 20 from thermal runaway and allows the LED 20 to be driven at or near maximum current without the LED being destroyed. The subject circuit can be used to drive white LEDs which offer superior light quality and brightness.

Figure 2:
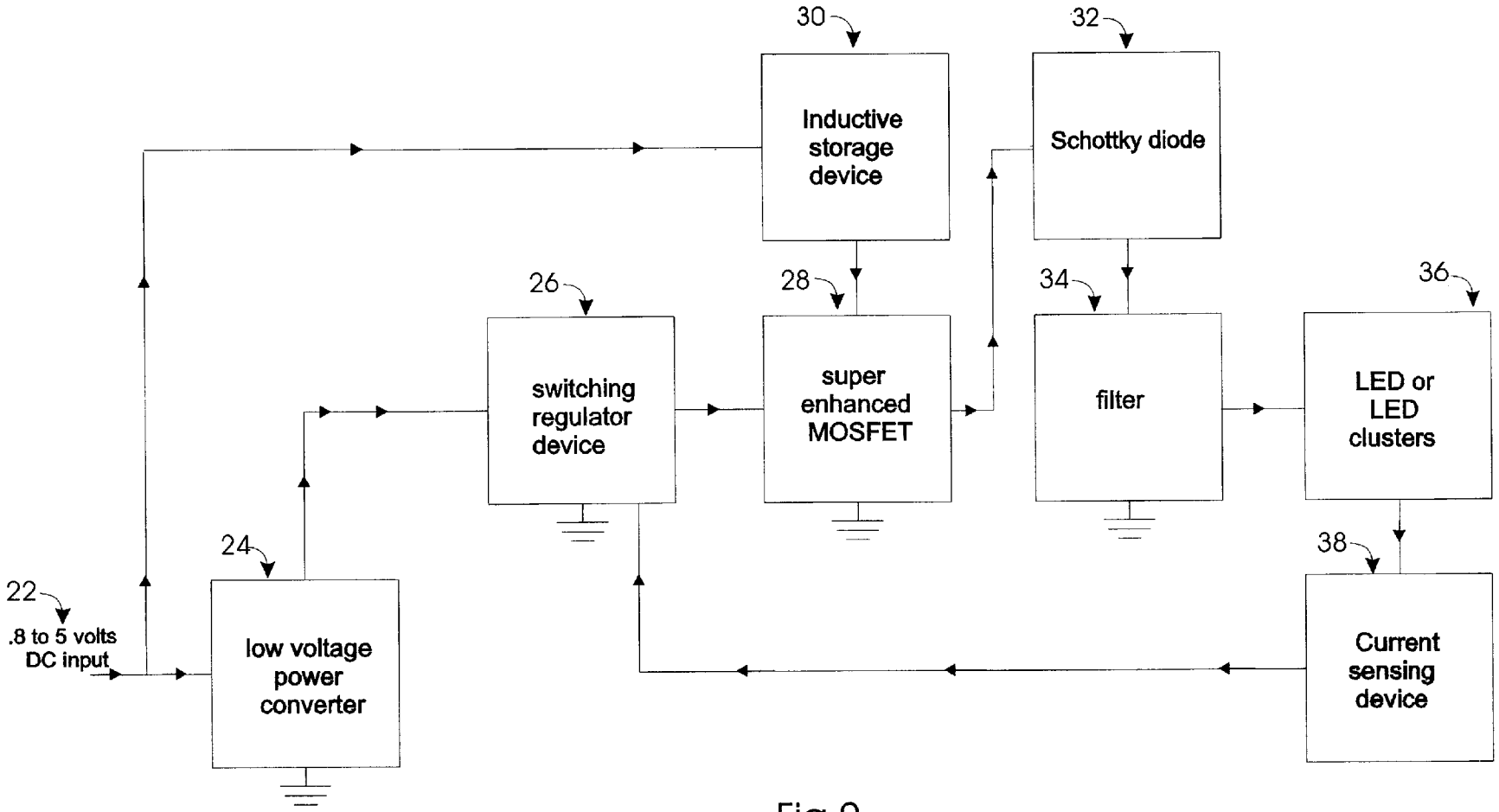
FIG. 2 shows another specific embodiment of a circuit in accordance with the subject invention.

FIG. 2 shows another specific embodiment of a circuit in accordance with the subject invention. This circuit is an enhanced version of the circuit shown in FIG. 1, and can use a lower voltage input to drive more LEDs. In this circuit, the switching regulator device comprises a programmable reference voltage source and is driven by a low voltage power converter. The switching regulator device also has an external super enhanced MOSFET.

The DC power input 22 provides power to the inductive storage device 30. Within the inductive storage device 30 energy is transformed into AC current. The energy is converted from AC to DC current by a rectifier 32. Preferably, the rectifier is a Schottky diode. The current is then filtered at 34 before being applied to the LEDs or LED clusters 36. A current sensing device 38 feeds a signal reference voltage back to a switching regulator device 26 providing current load information for regulating the circuit. Preferably, the current sensing device 38 is a resistor having a resistance of less than about 15 ohms (ω).

The switching regulator device 26 monitors the signal from the current sensing device 38 and regulates the energy released into the circuit. In a specific embodiment, the switching regulator device 26 requires about 3 V of power. A low voltage power converter circuit 24 is introduced into the circuit to provide the power necessary to run the switching regulator device 26. Preferably, the low voltage power converter is capable of producing 3 V when supplied with as little as 0.8 V input. The converter circuit should further be capable of producing about 20 mA when supplied with the 0.8 V DC input. The low voltage power converter 24 supplies the 3 V necessary to power the switching regulator device 26. The switching regulator device 26 can incorporate a programmable reference voltage source, an oscillation circuit, and an error amplifier. An external super enhance MOSFET 28 is controlled by the switching regulator device 26 and loads the inductive storage device 30. The super enhanced MOSFET is a very efficient transistor and requires very little current to operate. In a further specific embodiment, the switching regulator device 26 can also have a high current power converter capable of driving at least 16 white LEDs. Thus, this embodiment of the subject circuit can drive up to 16 LEDs with as little as 0.8 V input.

The circuitry of the subject invention can allow a number of LEDs to be driven with very little voltage input. A single AAA battery can be used to power a specific embodiment of the subject circuit. The subject circuit can also be powered by more than one battery, or, for example, by AA, C, or D batteries. The subject circuitry can be used with LEDs in a low power consumption flashlight to provide a bright, lightweight piece of equipment. Flashlights or headlamps can utilize the circuit of the subject invention to present maximum white LED brightness, allowing fewer LEDs to be used and thus, lowering manufacturing costs. Flashlights or headlamps incorporating the circuitry of the subject invention also can consume less power than typical devices. For example, a flashlight with a standard incandescent bulb consumes 500 mA, while a flashlight using the circuit of the subject invention can consume on the order of only 80 mA to illuminate three white LEDs.

Figure 3:
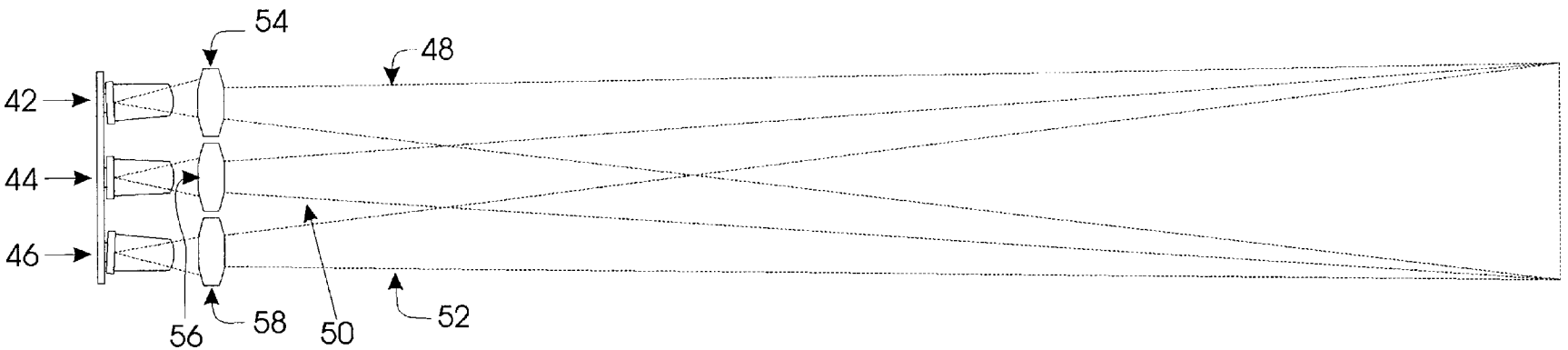
FIG. 3 shows primary lenses superimposing the beam patterns of three light emitting diodes (LEDs) driven by the circuit of the subject invention.

The beam patterns of light from LEDs driven by the circuitry of the subject invention, or by other circuitry know in the art, can be superimposed to provide a bright, clean beam of light suitable for illuminating surgical procedures. In a specific embodiment, the beam patterns can be superimposed by, for example, placing primary lenses in the beam path. FIG. 3 shows the beam patterns of three LED lamps being superimposed using primary lenses. FIG. 3 shows a group of three LEDs 42, 44 and 46. Each of these LEDs produce a beam pattern, 48, 50 and 52, respectively, which is superimposed on the others using primary lenses 54, 56 and 58, respectively.

Lenses useful in this process can be made of, for example, glass or plastic. Plastic lenses are less expensive to manufacturer and lighter in weight. Simple convex lenses, which bend the beams to meet one another, can be used to superimpose the beam patterns, primary lenses can be placed in the beam path of each lamp. Primary lens 56 is placed in front of LED 44 at direct center. To properly focus and superimpose the beam patterns of LEDs 42 and 46 on the beam pattern of LED 44, primary lenses 54 and 58 are placed slightly off-set from center of the LEDs and away from the center LED 44. Alternatively, the LEDs can be canted so their beams are directed to the edge of the lens. The beam pattern of the LEDs are bent to superimpose upon one another further intensifying the brightness of the light and providing a clean, crisp light suitable for illuminating delicate medical procedures. The foregoing describes a process by which the beam patterns of three LEDs in a line are superimposed upon one another. It should be apparent to those skilled in the art that the beam patterns of groups of LEDs in any configuration can be superimposed on one another by arranging and off-setting the LEDs or lenses as described.

Figure 4A:
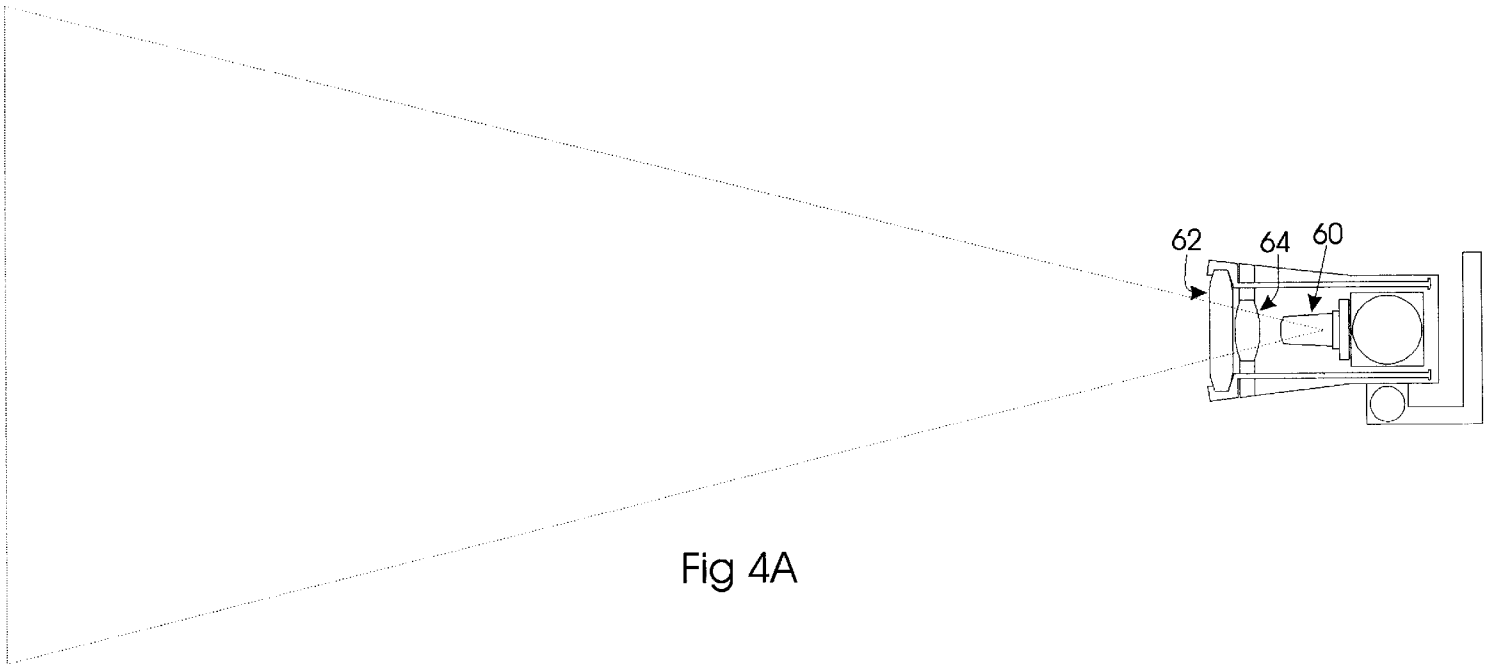
FIG. 4A shows a specific embodiment of an open zoom apparatus for a LED driven by a circuit in accordance with the subject invention.
Figure 4B:
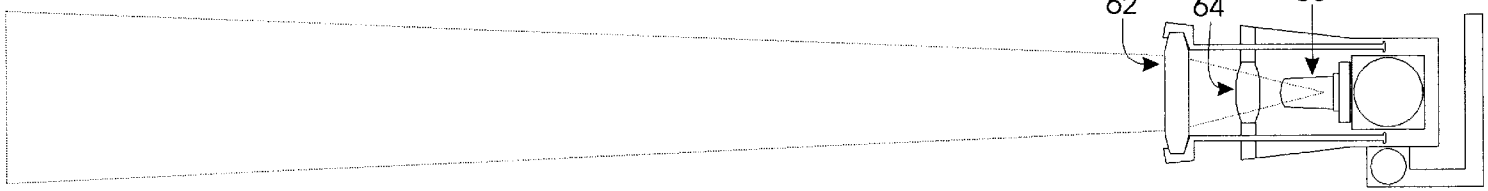
FIG. 4B shows a specific embodiment of a focused zoom apparatus for a LED driven by a circuit in accordance with the subject invention.

The light from an LED or LEDs driven by the circuit of the subject invention can be further manipulated using a zoom lens to allow the light to be scattered into a diffuse uniform beam pattern or focused into a sharp, bright light. A second moveable zoom lens placed in the beam path of an LED can be used to adjust and focus the light. FIGS. 4A and 4B show an LED 60 focused with a zoom lens 62. A primary lens 64 is placed in the path of the LED 60 to direct the light beam. Light exiting the primary lens 64 is caught by the zoom lens 62. The zoom lens 62 can be made of, for example, glass or plastic and in the exemplified embodiment is a simple convex lens. The distance between the zoom lens 62 and the primary lens 64 determines the final beam pattern of the lamp. FIG. 4A shows that when the zoom lens 62 is close to the primary lens 64 the beam pattern is wide and diffuse. As the distance between the lenses increases the beam pattern becomes constricted and focused (FIG. 4B). The beam pattern from a series of superimposed LEDs could be likewise focused using a zoom lens. Further, it is apparent to those skilled in the art that a variety of lens systems can be employed to achieve similar results.

The circuitry of the subject invention can comprise an inductive storage device, a switching regulator device and a current sensing device in a closed loop feedback system. The circuitry can insure that the proper voltage is applied to an LED or LED cluster to protect the LEDs from thermal runaway. The circuitry can further allow a number of LEDs to be driven with a low voltage input with the subject circuit being from about 70% to about 99% efficient, and preferably at least about 90% efficient, and most preferably at lest about 97% efficient.

It should be understood that the examples and embodiments described herein are for illustrative purposes only and that various modifications or changes in light thereof will be suggested to persons skilled in the art and are to be included within the spirit and purview of this application and the scope of the appended claims.

What is claimed is:

1. A circuit for driving light emitting diodes comprising: an inductive storage device, a switching regulator device, a rectifier, a filter, and a current sensing device wherein said inductive storage device is wire wound with an inductance between about 22 and 220 micro henries, wherein said switching regulator device comprises a programmable reference voltage source, an oscillation circuit, and an error amplifier, wherein said rectifier is a Schottky diode, and wherein said current sensing device and said switching regulator device are a temperature compensation circuit comprising an error amplifier, a current sensing resistor, at least two reference voltage resistors, and a transistor as a power driver, and wherein said circuit further comprises a low voltage power converter circuit capable of producing 3 volts and 20 milliamps when supplied with at least 0.8 volts input and a super enhanced MOSFET.

2. A circuit for driving light emitting diodes comprising: an inductive storage device, a switching regulator device, a rectifier, a filter, and a current sensing device, wherein said inductive storage device is wire wound with an inductance between about 22 and 220 micro henries, wherein said switching regulator device is a CMOS PWM/PEM-control step-up switching regulator, wherein said rectifier is a Schottky diode, and wherein said current sensing device and said switching regulator device are a temperature compensation circuit comprising an error amplifier, a current sensing resistor, at least two reference voltage resistors, and a transistor as a power driver.

3. An illumination device, comprising: a circuit comprising an inductive storage device, a switching regulator device, a rectifier, a filter, and a current sensing device, wherein said power source is at least one AAA battery, said switching regulator device comprises a programmable reference voltage source, an oscillation circuit and an error amplifier, and wherein said circuit further comprises a low voltage power converter circuit capable of producing 3 volts and 20 milliamps when supplied with at least 0.8 volts input and a super enhanced MOSFET.

4. A circuit for driving light emitting diodes comprising: an inductive storage device, a switching regulator device, a rectifier, a filter, a current sensing device and a low voltage power converter circuit, wherein said low voltage power converter circuit produces 3 volts and 20 milliamps when supplied with at least 0.8 volts input.

* * * * *